US009975236B2

(12) United States Patent
Hua et al.

(10) Patent No.: US 9,975,236 B2
(45) Date of Patent: May 22, 2018

(54) MULTI-STAGE TRIGGER ASSEMBLY FOR USE IN A PNEUMATIC TOOL

(71) Applicant: Basso Industry Corp., Taichung (TW)

(72) Inventors: Chiang Hua, Taichung (TW); Chin-Cheng Lee, Taichung (TW)

(73) Assignee: Basso Industry Corp., Taichung (TW)

( * ) Notice: Subject to any disclaimer, the term of this patent is extended or adjusted under 35 U.S.C. 154(b) by 572 days.

(21) Appl. No.: 14/591,144

(22) Filed: Jan. 7, 2015

(65) Prior Publication Data

US 2015/0190917 A1 Jul. 9, 2015

(30) Foreign Application Priority Data

Jan. 9, 2014 (TW) ..... 103200430 U

(51) Int. Cl.
*B25F 5/02* (2006.01)
*B25F 5/00* (2006.01)

(52) U.S. Cl.
CPC . *B25F 5/02* (2013.01); *B25F 5/00* (2013.01)

(58) Field of Classification Search
CPC ..... B25F 5/00; B25F 5/02
USPC ..... 173/20, 168, 169; 89/136; 227/8, 227/119–134, 156
See application file for complete search history.

(56) References Cited

U.S. PATENT DOCUMENTS 2,493,957 A * 1/1950 Fitch ..... B23B 45/04 173/169
2,729,198 A * 1/1956 Faccou ..... B25C 1/041 173/168
2,814,277 A * 11/1957 Jimerson ..... B25B 23/1453 173/109
2,989,948 A * 6/1961 Forrester ..... B27F 7/34 173/169
3,010,430 A * 11/1961 Allen ..... B25C 1/041 173/169
3,326,240 A * 6/1967 McConnaughay ..... B25B 21/00 137/630.14
3,352,323 A * 11/1967 Wickham ..... B25B 21/00 137/625.26
3,666,027 A * 5/1972 Sauerwein ..... B23B 45/04 173/169
3,718,313 A * 2/1973 Miller ..... F16K 31/44 173/169
3,924,693 A * 12/1975 Whitehouse ..... B23B 45/04 137/529
3,949,944 A * 4/1976 Bent ..... H01R 43/033 140/124

(Continued)

*Primary Examiner* — Gloria R Weeks
*Assistant Examiner* — William A Weller
(74) *Attorney, Agent, or Firm* — The Mueller Law Office, P.C.

(57) ABSTRACT

A trigger assembly used in a pneumatic tool that includes a valve unit removably blocking a flow channel, includes a driving member, a trigger member and a positioning unit. The driving member is movable for actuating the valve unit to gradually unblock the flow channel. The trigger member is pressable to move relative to a tool body of the pneumatic tool and the driving member to drive movement of the driving member. The positioning unit includes first and second positioning structures inter-engaged for providing an indication when the trigger member is pressed to move the driving member to a certain position.

7 Claims, 10 Drawing Sheets

(56) References Cited

U.S. PATENT DOCUMENTS 4,024,892 A * 5/1977 Prisco ..... B25B 21/00 137/630.14
4,384,668 A * 5/1983 Tutomu ..... B25C 1/008 173/169
4,844,177 A * 7/1989 Robinson ..... B25B 23/145 173/169
5,259,465 A * 11/1993 Mukoyama ..... B25C 1/047 173/168
5,303,781 A * 4/1994 Lin ..... B25F 5/02 173/169
5,353,474 A * 10/1994 Good ..... B25F 5/006 16/421
5,377,769 A * 1/1995 Hasuo ..... B25B 21/02 173/169
5,522,532 A * 6/1996 Chen ..... B25C 1/008 227/130
5,797,462 A * 8/1998 Rahm ..... B25B 21/00 173/169
5,913,370 A * 6/1999 Chapelle ..... B25B 21/00 173/169
5,924,621 A * 7/1999 Hung ..... B25C 1/043 227/130
5,974,611 A * 11/1999 Casella ..... F41B 11/87 124/56
6,047,780 A * 4/2000 Lin ..... F16K 11/0743 173/168
6,062,323 A * 5/2000 Pusateri ..... B25B 21/02 173/169
6,145,724 A * 11/2000 Shkolnikov ..... B25C 1/08 227/10
6,164,387 A * 12/2000 Chang ..... B25F 5/00 173/169
6,213,372 B1 * 4/2001 Chen ..... B25C 1/008 227/130
6,443,239 B1 * 9/2002 Izumisawa ..... B25B 21/02 173/168
6,588,642 B1 * 7/2003 Wang ..... B25C 1/008 227/130
6,902,011 B2 * 6/2005 Hall ..... B25B 23/1453 173/168
6,991,043 B1 * 1/2006 Chen ..... B25F 5/00 173/168
7,070,080 B2 * 7/2006 Lin ..... B25C 1/008 227/130
7,252,158 B2 * 8/2007 Kirsch ..... B22D 31/00 173/168
7,255,326 B2 * 8/2007 Wang ..... B25C 1/043 173/169
7,316,341 B2 * 1/2008 Schnell ..... B25C 1/008 173/168
7,325,627 B2 * 2/2008 Tanji ..... B25F 5/00 173/168
7,431,102 B2 * 10/2008 Hua ..... B25B 21/00 173/104
7,464,843 B2 * 12/2008 Huang ..... B25C 1/04 173/170
7,484,649 B2 * 2/2009 Schnell ..... B25C 1/008 173/168
7,594,549 B2 * 9/2009 Hua ..... B25B 21/00 173/104
7,802,633 B2 * 9/2010 Kobayashi ..... B25B 21/00 137/625.43
7,975,890 B2 * 7/2011 Tang ..... B25C 1/008 227/130
8,020,631 B2 * 9/2011 Kobayashi ..... B25B 21/00 137/625.43
8,109,425 B2 * 2/2012 Liu ..... B25F 5/00 227/130
2004/0060718 A1 * 4/2004 Izumisawa ..... B25F 5/00 173/169
2004/0144553 A1 * 7/2004 Ashbaugh ..... B25F 5/00 173/169
2005/0023319 A1 * 2/2005 Huang ..... B25C 1/008 227/8
2006/0011366 A1 * 1/2006 Liao ..... B25F 5/00 173/169
2009/0314818 A1 * 12/2009 Segura ..... B25C 1/008 227/8
2010/0012700 A1 * 1/2010 Perron ..... B25C 1/008 227/8
2010/0038398 A1 * 2/2010 Liang ..... B25C 1/042 227/8
2010/0301091 A1 * 12/2010 Liang ..... B25C 1/043 227/8
2011/0132959 A1 * 6/2011 Hlinka ..... B25C 1/06 227/8
2014/0027253 A1 * 1/2014 Braun ..... B25D 17/00 200/61.58 R
2014/0090861 A1 * 4/2014 Hua ..... B25F 5/00 173/169
2014/0110142 A1 * 4/2014 Hua ..... B25F 5/00 173/169
2015/0165611 A1 * 6/2015 Puppala ..... B25C 1/008 227/8
2015/0306746 A1 * 10/2015 Chen ..... B25B 21/00 173/169

* cited by examiner

MULTI-STAGE TRIGGER ASSEMBLY FOR USE IN A PNEUMATIC TOOL

CROSS-REFERENCE TO RELATED APPLICATION

This application claims priority of Taiwanese Application No. 103200430, filed on Jan. 9, 2014.

FIELD OF THE DISCLOSURE

The disclosure relates to a trigger assembly, more particularly to a multi-stage trigger assembly for use in a pneumatic tool.

BACKGROUND OF THE DISCLOSURE

Referring to FIGS. 1 and 2, a conventional pneumatic tool disclosed in Taiwanese Utility Model Patent No. M396733 includes a tool body 11 that is formed with a flow channel 12, a valve unit 13 that includes a first valve member 131 and a second valve member 133, and a trigger member 14 that is connected co-movably to the first valve member 131. The first valve member 131 has a valve portion 132. The second valve member 133 is connected movably to the first valve member 131. With the trigger member 14 being pressed to move along an axis (A) from a first position (see FIG. 1) to a second position (see FIG. 2), the valve portion 132 of the first valve member 131 and the second valve member 133 in turn unblock the flow channel 12 to obtain different opening degrees of the flow channel 12. However, a user can hardly perceive opening degree of the flow channel 12 since there is no distinct indication during the movement of the trigger member 14 from the first position to the second position.

Referring to FIG. 3, another convention pneumatic tool 2 includes a tool body 21 and a trigger member 22 connected pivotally to the tool body 21. The trigger member 22 is pressable to drive a valve unit to gradually unblock a flow channel formed in the tool body 21. However, there is no means for indicating opening degree of the flow channel.

SUMMARY OF THE DISCLOSURE

Therefore, the object of the present disclosure is to provide a multi-stage trigger assembly that can overcome the aforesaid drawback associated with the prior arts.

Accordingly, a multi-stage trigger assembly of the present disclosure is for use in a pneumatic tool. The pneumatic tool includes a tool body that is formed with a flow channel for guiding an airflow, and a valve unit that removably blocks the flow channel. The multi-stage trigger assembly includes a driving member, a trigger member and a positioning unit. The driving member is mounted to the tool body and movable relative to the tool body along an axis between first and second positions for actuating the valve unit. The driving member and the valve unit are configured such that the valve unit gradually unblocks the flow channel to increase opening degree of the flow channel in response to movement of the driving member from the first position to the second position. The trigger member is pressable to move relative to the tool body and the driving member to drive the movement of the driving member from the first position to the second position. The positioning unit includes first and second positioning structures that are provided respectively at any two of the driving member, the trigger member and the tool body, and configured such that when the trigger member is pressed to move the driving member from the first position to an intermediate position located between the first and second positions, the first and second positioning structures are inter-engaged for providing an indication.

BRIEF DESCRIPTION OF THE DRAWINGS

Other features and advantages of the present disclosure will become apparent in the following detailed description of the embodiments with reference to the accompanying drawings, of which.

DETAILED DESCRIPTION OF THE EMBODIMENTS

Figure 1:
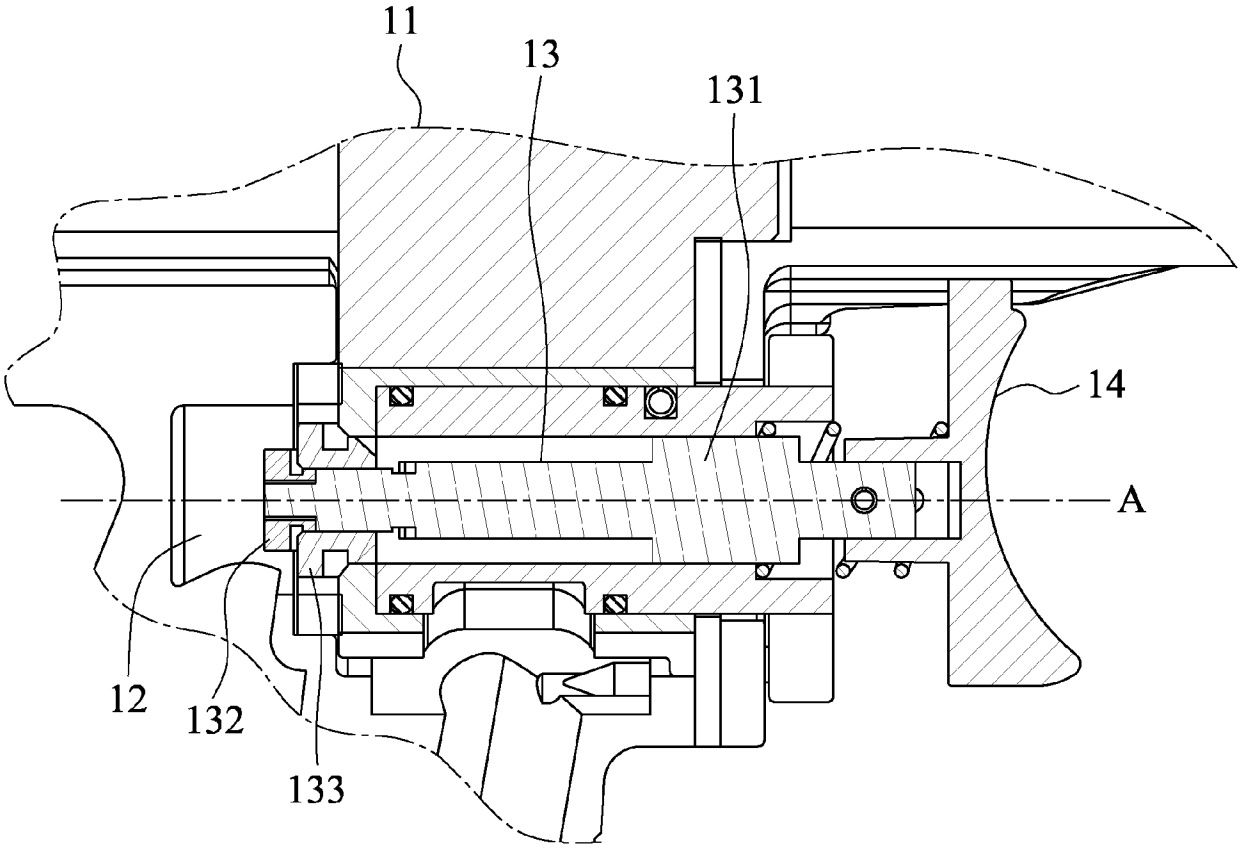
FIG.1 PRIOR ART
FIG. 1 is a fragmentary sectional view of a conventional pneumatic tool disclosed in Taiwanese Utility Model Patent No. M396733, illustrating a trigger assembly being released.
Figure 2:
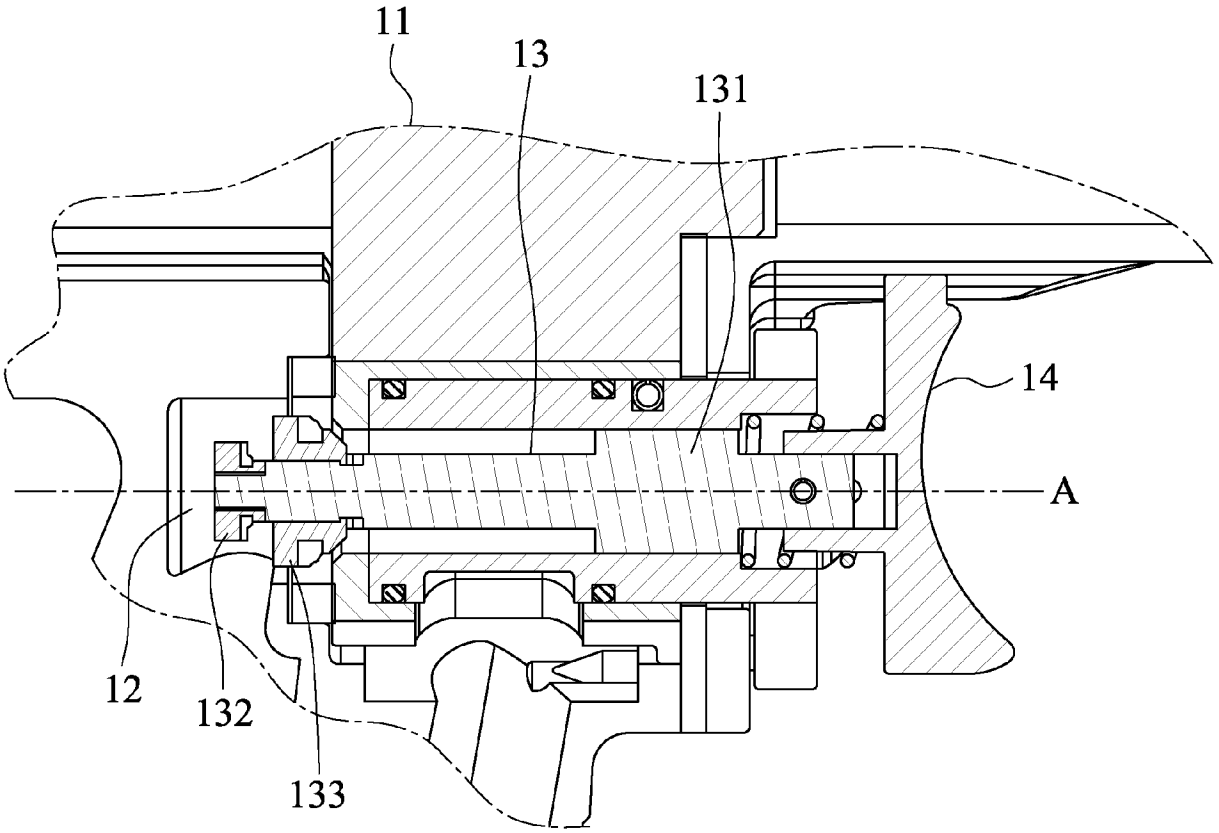
FIG.2 PRIOR ART
FIG. 2 is another fragmentary sectional view of the conventional pneumatic tool, illustrating the trigger assembly being pressed.
Figure 3:
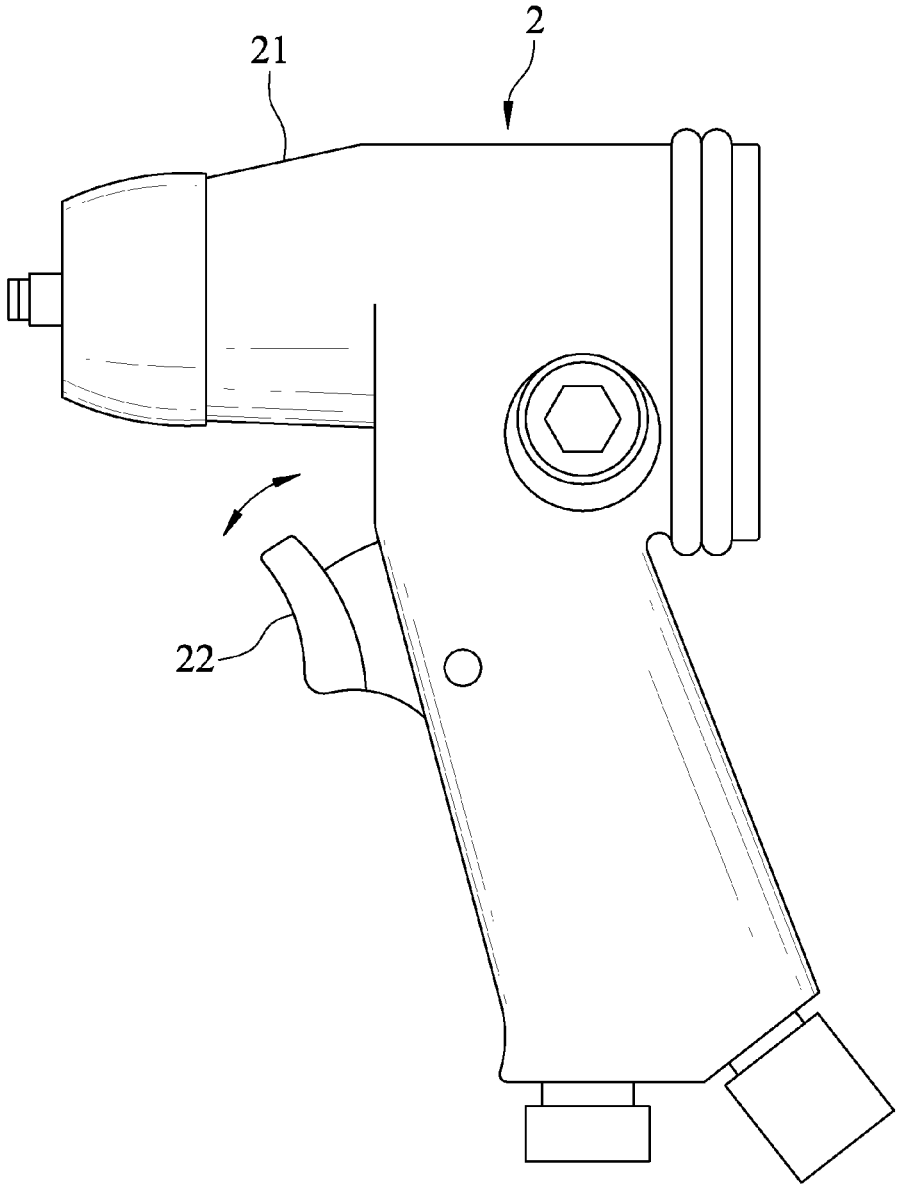
FIG.3 PRIOR ART
FIG. 3 is a side view of another conventional pneumatic tool.

Before the pre sent disclosure is described in greater detail, it should be noted that like elements are denoted by the same reference numerals throughout the disclosure.

Figure 4:
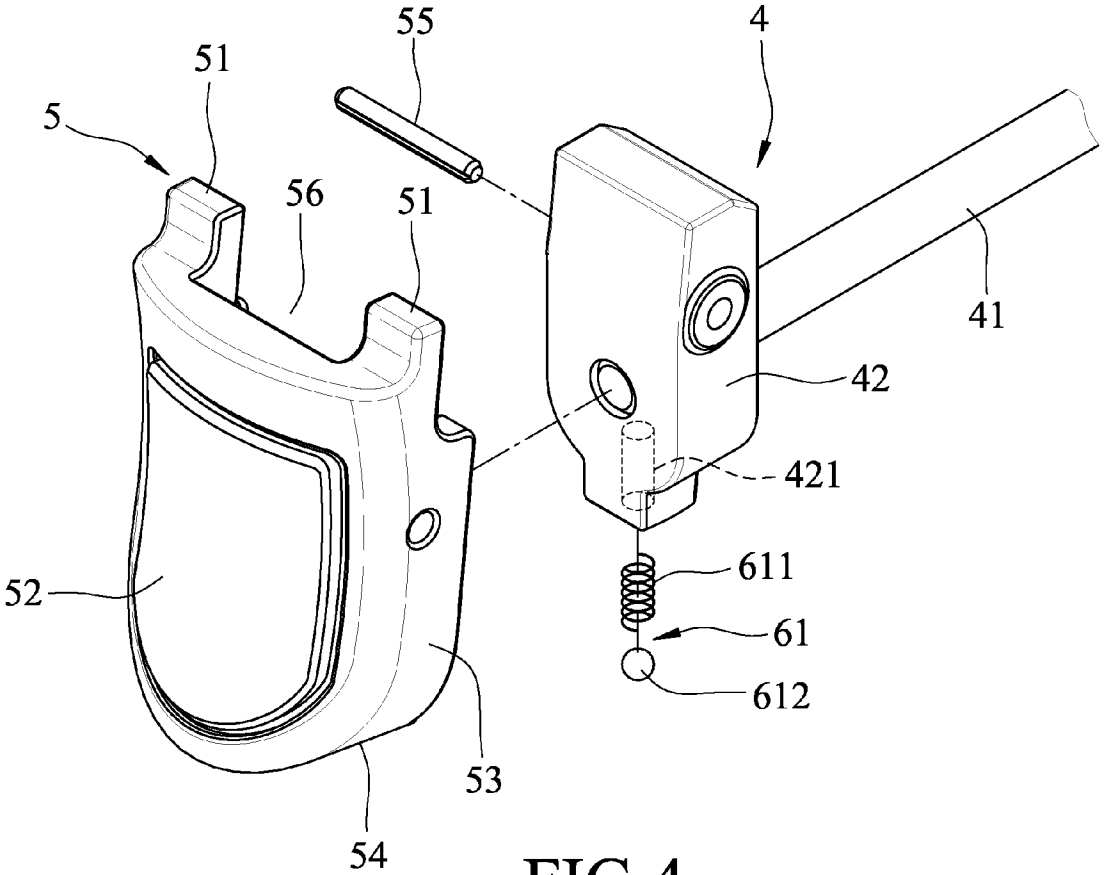
FIG. 4 is a fragmentary exploded perspective view of a first embodiment of a multi-stage trigger assembly according to the disclosure.
Figure 5:
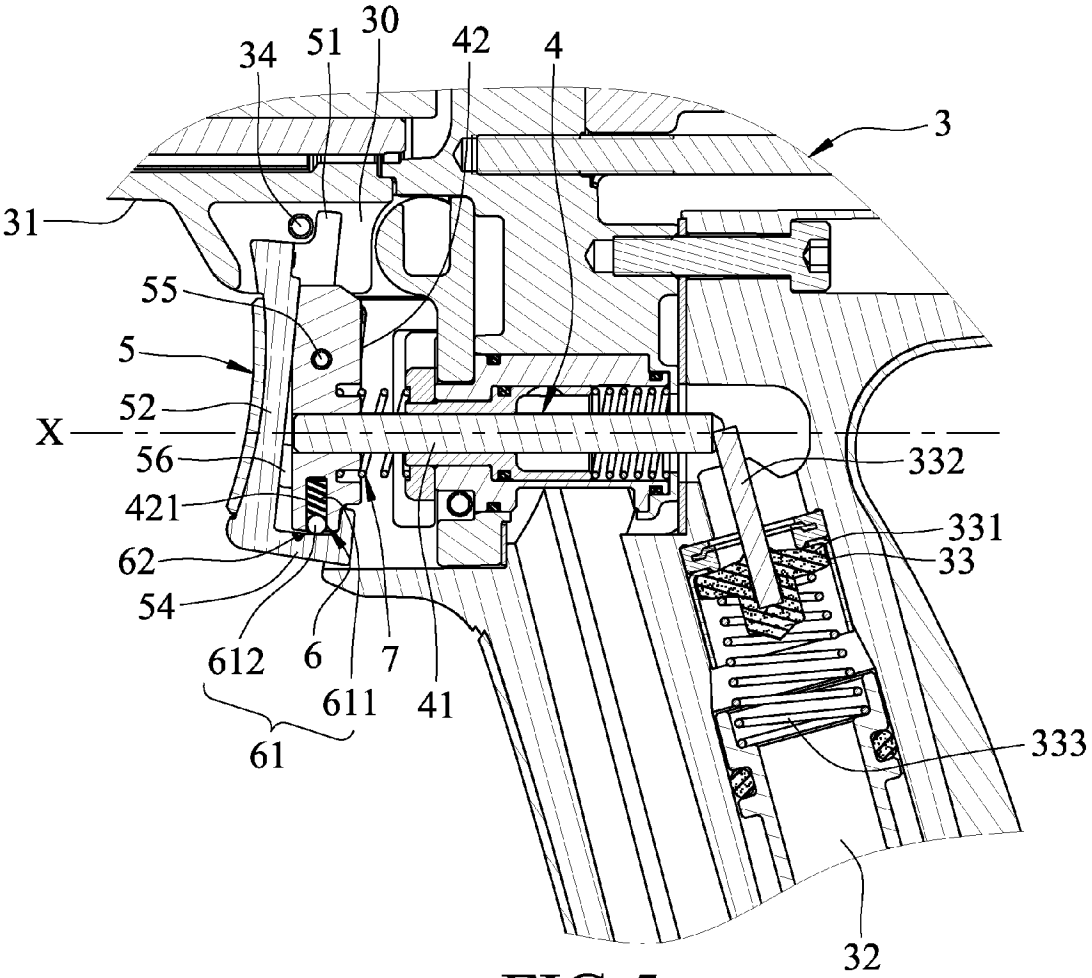
FIG. 5 is a sectional view of the first embodiment, illustrating a driving member being at a first position.

As shown in FIGS. 4 and 5, a first embodiment of a multi-stage trigger assembly according to the present disclosure is for use in a pneumatic tool 3. The pneumatic tool 3 includes a tool body 31 that is formed with a flow channel 32 for guiding compressed air, and a valve unit 33 that removably blocks the flow channel 32. The valve unit 33 includes a valve member 331, a rod member 332 that is connected co-movably to the valve member 331, and a restoring spring 333 that has opposite ends connected respectively to the tool body 31 and the valve member 331, and that biases resiliently the valve member 331 to block the flow channel 32. The first embodiment of the multi-stage trigger assembly includes a driving member 4, a trigger member 5, a connecting rod 55, a limiting member 34, a positioning unit 6 and a resilient member 7.

Figure 6:
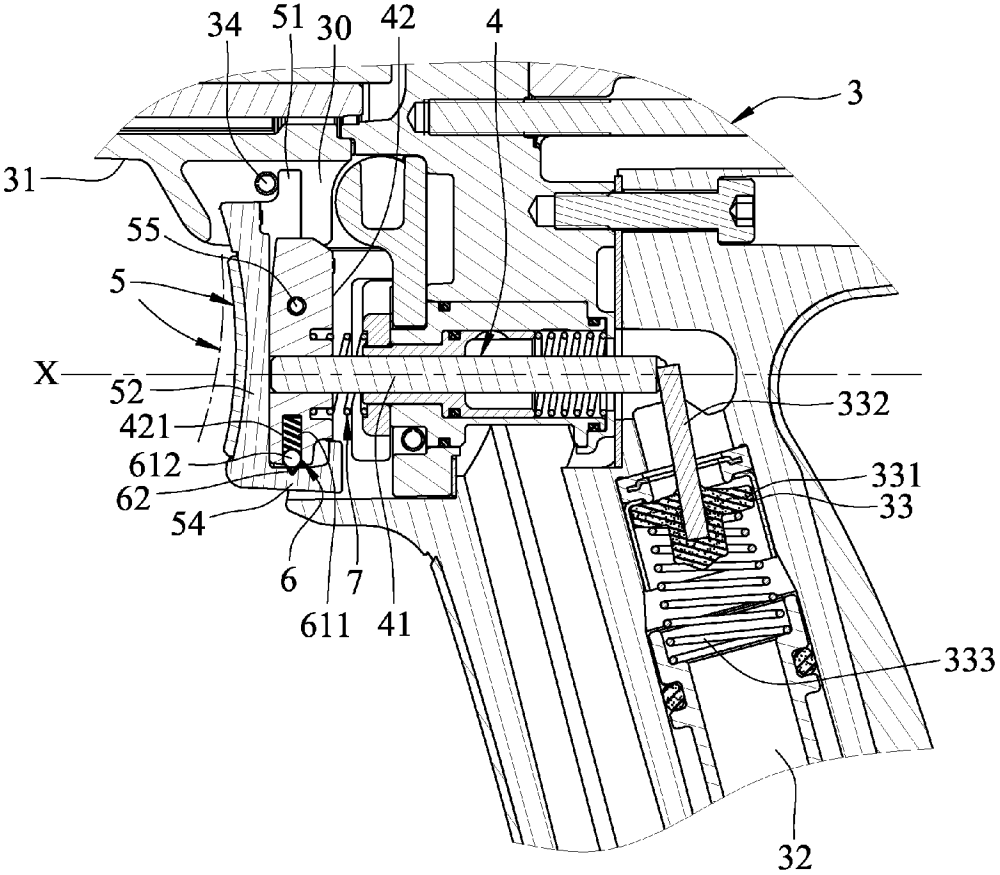
FIG. 6 is another sectional view of the first embodiment, illustrating the driving member being at an intermediate position.
Figure 7:
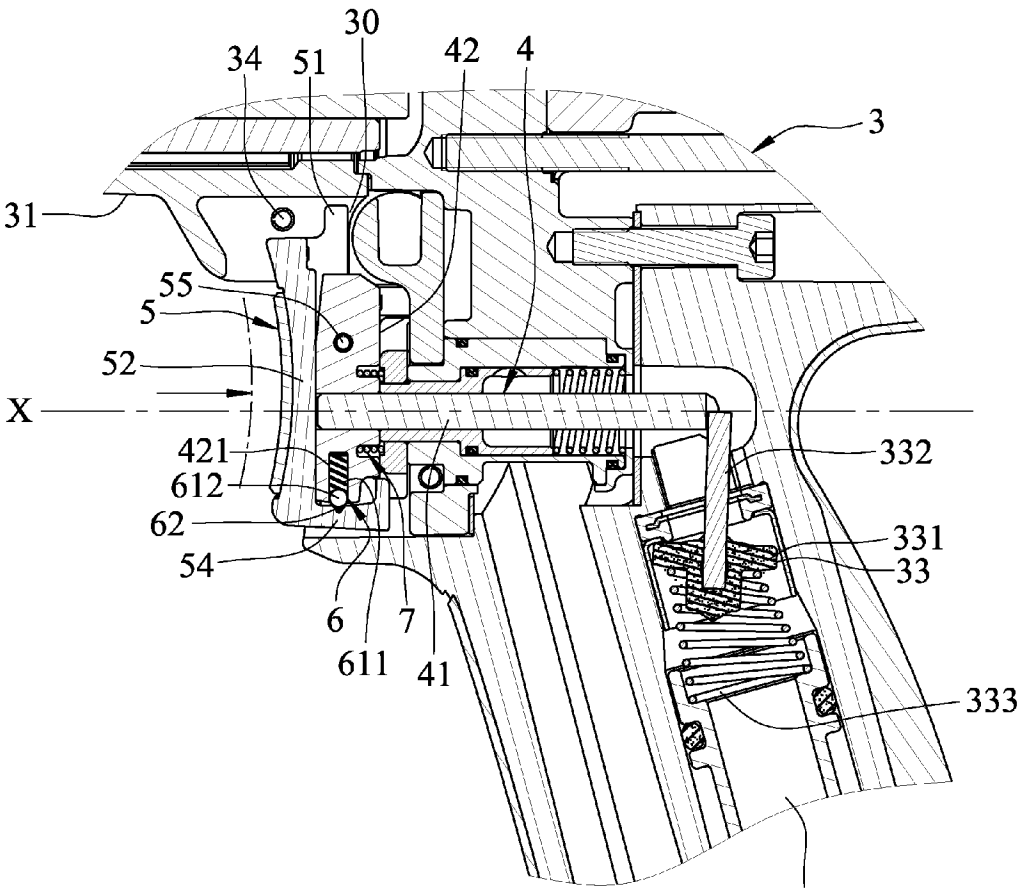
FIG. 7 is still another sectional view of the first embodiment, illustrating the driving member being at a second position.

The driving member 4 is mounted to the tool body 31, and is movable relative to the tool body 31 along an axis (X) between a first position (see FIG. 5) and a second position (see FIG. 7). The driving member 4 has a rod portion 41 and a mount portion 42. The rod portion 41 extends along the axis (X), and has an end abutting against the rod member 332 of the valve unit 33 such that the valve member 331 gradually unblocks the flow channel 32 against the biasing action of the restoring spring 333 to increase opening degree of the flow channel 32 in response to movement of the driving member 4 from the first position to the second position. The mount portion 42 is connected co-movably to an opposite end of the rod portion 41 distal from the valve unit 33. In this embodiment, the travel of the driving member 4 is divided into first and second stages by an intermediate position (see FIG. 6) that is located between the first and second positions. The driving member 4 is in the first stage when it is located between the first position and the intermediate position, and is in the second stage when it is located between the intermediate position and the second position. That is, when the driving member 4 is in the second stage, the flow channel 32 has a greater opening degree.

The trigger member 5 is connected pivotally to the mount portion 42 of the driving member 4 by the connecting rod 55, and is pressable to move relative to the tool body 31 and the driving member 4 to drive the movement of the driving member 4 from the first position to the second position.

The trigger member 5 has a press portion 52 that is disposed at one side of the mount portion 42 of the driving member 4 opposite to the valve unit 33, a pair of lateral walls 53 that extend respectively from two lateral sides of the press portion 52 toward the valve unit 33, and a bottom wall 54 that extends from a bottom side of the press portion 52 toward the valve unit 33 and that has two opposite ends connected respectively to the lateral walls 53. The press portion 52 cooperates with the lateral walls 53 and the bottom wall 54 to define a retaining space 56 thereamong for retaining the mount portion 42.

The connecting rod 55 extends through the lateral walls 53 of the trigger member 5 and the mount portion 42 of the driving member 4 in a direction perpendicular to the direction of the axis (X) for interconnecting pivotally the trigger member 5 and the mount portion 42. The mount portion 42 of the driving member 4 has upper and lower sections that are respectively located above and below the connecting rod 55. The driving member 4 further has a blind hole 421 that is formed in a bottom surface of the lower section of the mount portion 42.

The resilient member 7 has opposite ends connected respectively to the tool body 31 and the driving member 4 for biasing resiliently the driving member 4 and the trigger member 5 away from the valve unit 33.

The tool body 31 is further formed with an elongate operation space 30 that extends in the direction of the axis (X). The trigger member 5 further has an upper end portion 51 that extends upwardly from the press portion 52 into the operation space 30, and that is disposed above the lateral walls 53. The limiting member 34 is disposed fixedly in the operation space 30, and is located at one side of the upper end portion 51 opposite to the valve unit 33.

The positioning unit 6 includes first and second positioning structures 61, 62 that are provided respectively at the driving member 4 and the trigger member 5. The second positioning structure 62 is provided at an inner surface of the bottom wall 54 of the trigger member 5 that faces the bottom surface of the mount portion 42, and is configured as a recess. The first positioning structure 61 includes a ball body 612 and a ball resilient member 611. The ball body 612 is movable along the blind hole 421. The ball resilient member 611 is disposed in the blind hole 421 and biases resiliently the ball body 612 to partially project out from the blind hole 421. The positioning unit 6 is configured such that when the trigger member 5 is pressed to move the driving member 4 from the first position to the intermediate position, the ball resilient member 611 biases resiliently the ball body 612 into the second positioning structure 62.

When the driving member 4 is at the first position, the driving member 4 and the trigger member 5 are biased by the resilient member 7 such that the upper end portion 51 of the trigger member 5 abuts against the limiting member 34 and the press portion 52 of the trigger member 5 abuts against the upper section of the mount portion 42.

To move the driving member 4 from the first position to the intermediate position, the trigger member 5 is pressed to pivot relative to the mount portion 42 of the driving member 4 against the biasing action of the resilient member 7 with the upper end portion 51 continuously abutting against the limiting member 34 until the press portion 52 abuts against the lower section of the mount portion 42 and the first and second positioning structures 61, 62 are inter-engaged to provide an indication. During the abovementioned operation, a user could press apart of the press portion 52 located below the connecting rod 55, and therefore the trigger member 5 pivots substantially about the limiting member 34 toward the valve unit 33 to drive movement of the driving member 4 via the connecting rod 55. Since the connecting rod 55 is located between the pivot point (the limiting member 34) and the pressed part of the press portion 52, the travel length of the pressed part of the press portion 52 is greater than that of the connecting rod 55 (i.e., greater than the travel length of the driving member 4). As a result, the movement of the driving member 4 can be controlled more precisely.

To move the driving member 4 from the intermediate position to the second position, the trigger member 5 can be pressed again to move toward the valve unit 33 against the biasing action of the resilient member 7 with the press portion 52 continuously abutting against the lower section of the mount portion 42 to drive movement of the driving member 4. During the abovementioned operation, the trigger member 5 is moved in the direction of the axis (X), and the travel length of the trigger member 5 is equal to that of the driving member 4.

It is noted that: to move the driving member 4 from the first position to the intermediate position, the user merely needs to apply a force smaller than the biasing force of the resilient member 7 on the part of the press portion 52 located below the connecting rod 55; and to move the driving member from the intermediate position to the second position, the user needs to apply a force greater than the biasing force of the resilient member 7 on the press portion 52 to overcome the biasing force of the resilient member 7.

The advantages of this disclosure are as follows.

1. By virtue of the positioning unit 6, a user can easily perceive whether the driving member 4 is moved past the intermediate position.

2. Via the configuration of the limiting member 34, the driving member 4 and the trigger member 5, the user can perceive that the driving member 4 is moved past the intermediate position with relative ease, since a resistant force exerted from the resilient member 7 increases distinctly.

Figure 8:
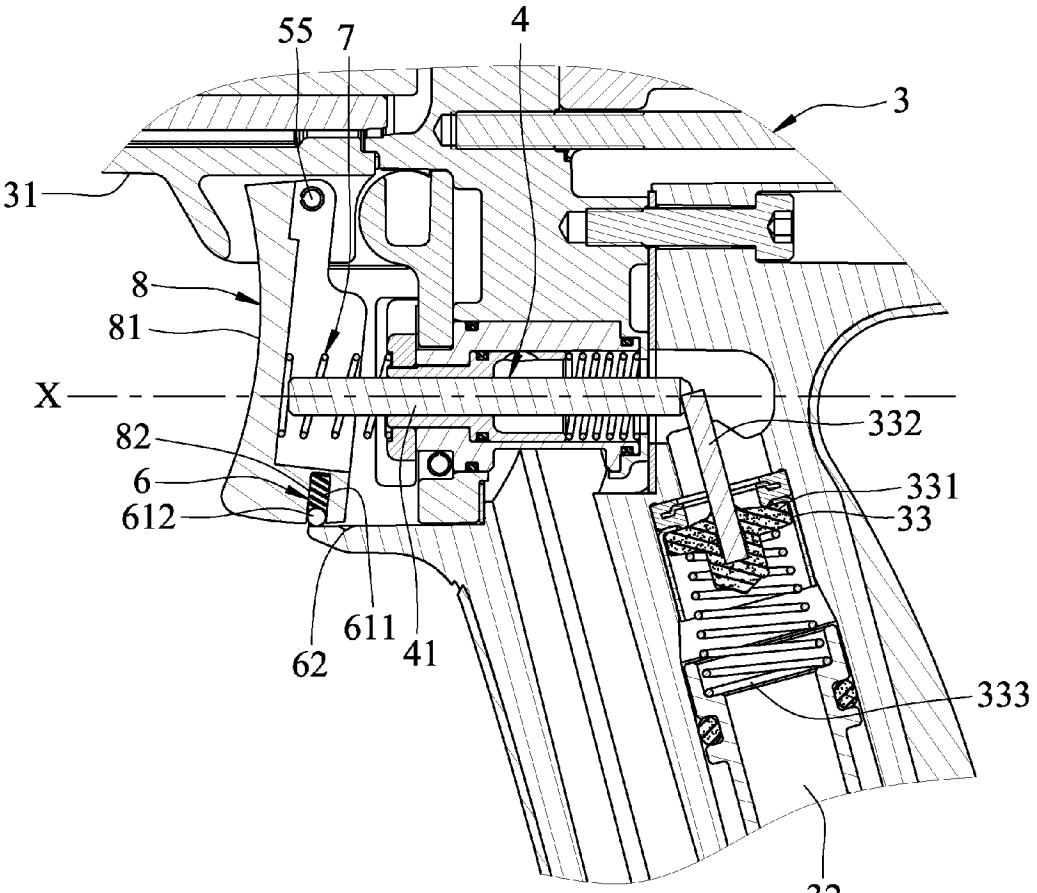
FIG. 8 is a sectional view of a second embodiment of the multi-stage trigger assembly according to the disclosure, illustrating a driving member being at a first position.
Figure 9:
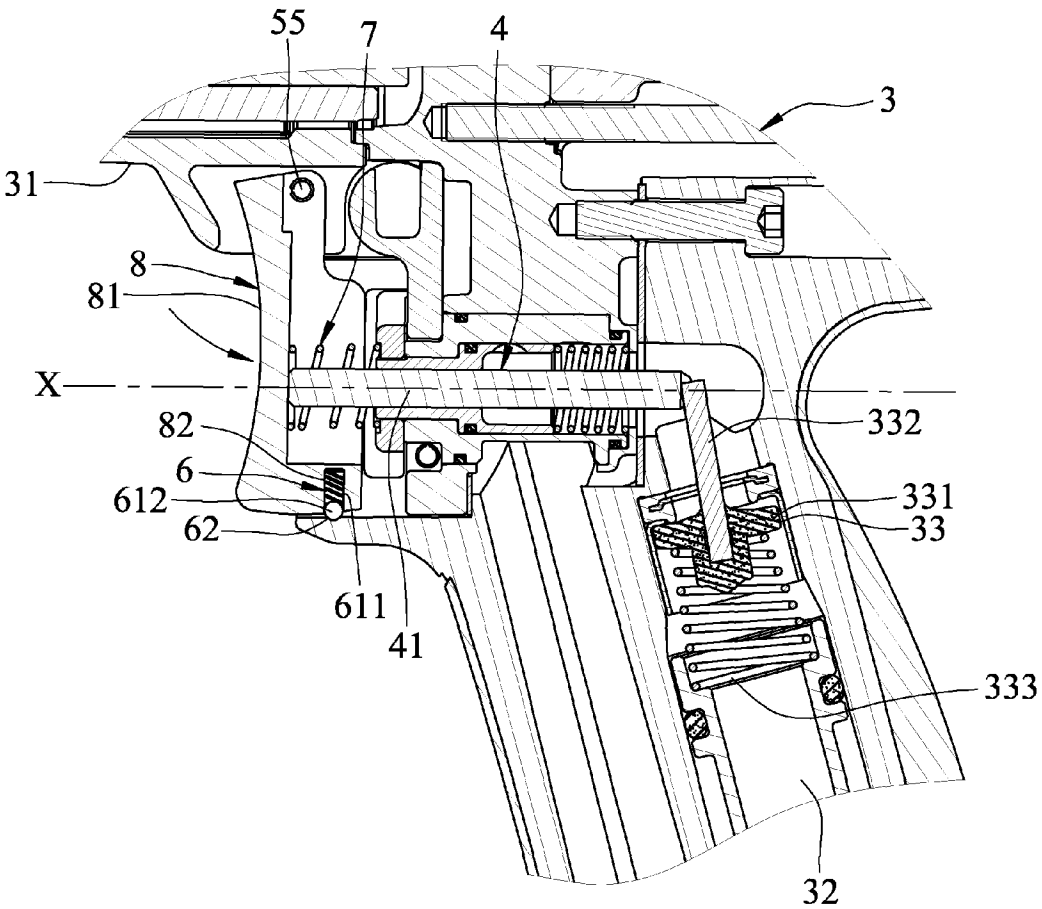
FIG. 9 is another sectional view of the second embodiment, illustrating the driving member being at an intermediate position.
Figure 10:
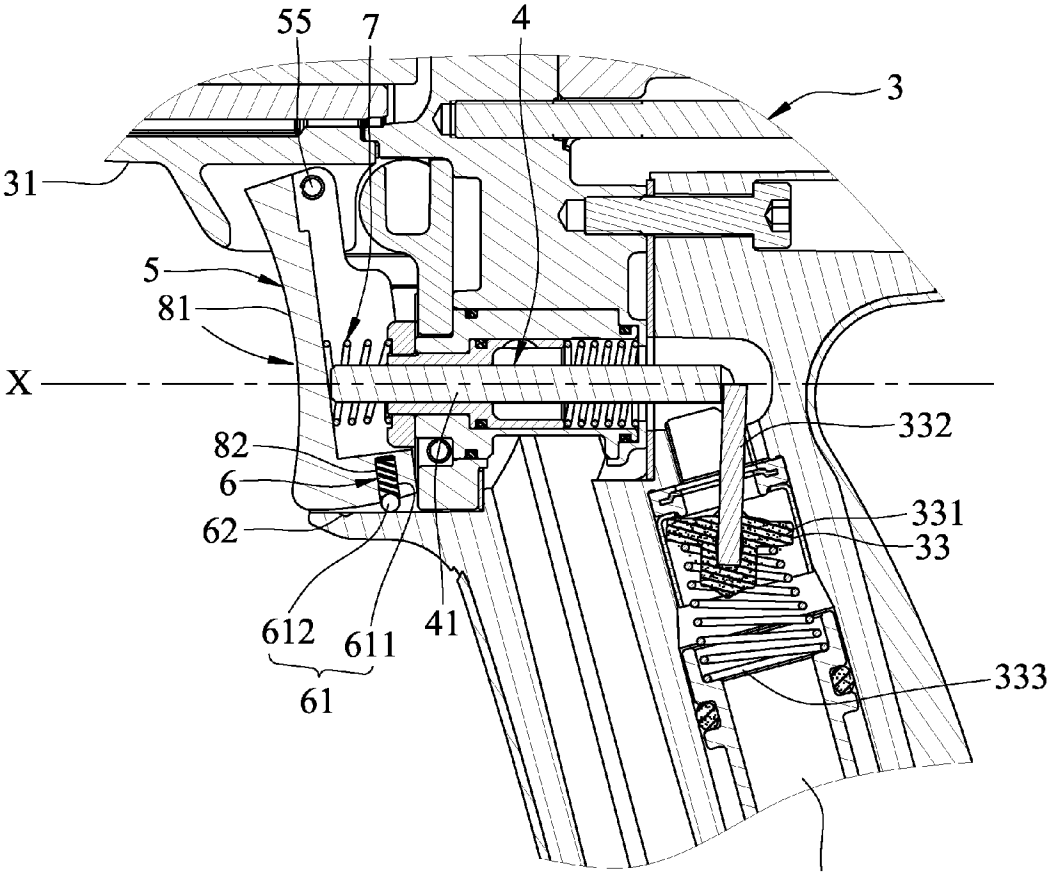
FIG. 10 is still another sectional view of the second embodiment, illustrating the driving member being at a second position.

Referring to FIGS. 8 to 10, a second embodiment of the multi-stage trigger assembly according to the present disclosure also includes a driving member 4, a trigger member 8, a connecting rod 55, a positioning unit 6 and a resilient member 7. However, the limiting member 34 (see FIG. 5) is omitted.

The trigger member 8 is connected pivotally to the tool body 31 by the connecting rod 55, is pressable to move relative to the tool body 31 and the driving member 4 to drive the movement of the driving member 4 from the first position (see FIG. 8) to the second position (see FIG. 10), and has an inner surface 81 that abuts against the driving member 4, and a blind hole 82 that is formed in a bottom surface thereof.

The first and second positioning structures 61, 62 of the positioning unit 6 are provided respectively at the trigger member 5 and the tool body 31. The second positioning structure 62 is provided at an inner surface of the tool body 31 that faces the bottom surface of the trigger member 8, and is configured as a recess. The first positioning structure 61 includes a ball body 612 and a ball resilient member 611. The ball body 612 is movable along the blind hole 82. The ball resilient member 611 is disposed in the blind hole 82 and biases resiliently the ball body 612 to partially project out from the blind hole 82. The positioning unit 6 is also configured such that when the trigger member 8 is pressed to move the driving member 4 from the first position to the intermediate position (see FIG. 9), the ball resilient member 611 biases resiliently the ball body 612 into the second positioning structure 62 for providing an indication.

While the present disclosure has been described in connection with what are considered the most practical embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A multi-stage trigger assembly adapted for use in a pneumatic tool, the pneumatic tool including a tool body that is formed with a flow channel for guiding an airflow, and a valve unit that removably blocks the flow channel, said multi-stage trigger assembly comprising:

a driving member adapted to be mounted to the tool body and movable relative to the tool body along an axis (X) between first and second positions, said driving member being adapted to be coupled to the valve unit, and moving the valve unit to gradually unblock the flow channel so as to increase opening degree of the flow channel when said driving member is moved from the first position to the second position;

a trigger member pressable to move relative to the tool body and said driving member to drive the movement of said driving member from the first position to the second position; and a positioning unit including first and second positioning structures that are adapted to be respectively provided at any two of said driving member, said trigger member and the tool body, said first and second positioning structures being misaligned and separated from each other when said trigger member is released, said first and second positioning structures being aligned and engaged with each other when said trigger member is pressed to move said driving member from the first position to an intermediate position located between the first and second positions;

wherein said driving member has a mount portion, said trigger member being pivotally connected to said mount portion of said driving member;

wherein said trigger member defines a retaining space therein for retaining said mount portion of said driving member, and has a bottom wall that has an inner surface partially defining said retaining space; and wherein said second positioning structure is provided at said inner surface of said bottom wall of said trigger member, said first positioning structure being provided at a bottom surface of said mount portion that faces said inner surface of said bottom wall.

2. The multi-stage trigger assembly as claimed in claim 1, wherein said driving member has a rod portion that extends along the axis (X) and that has an end adapted to abut against the valve unit, and an opposite end co-movably connected to said mount portion.

3. The multi-stage trigger assembly as claimed in claim 2, wherein said trigger member further has a press portion that is disposed at one side of said mount portion of said driving member opposite to the valve unit, and a pair of lateral walls that respectively extend from two lateral sides of said press portion toward the valve unit, said bottom wall extending from a bottom side of said press portion toward the valve unit and having two opposite ends respectively connected to said lateral walls, said press portion cooperating with said lateral walls and said bottom wall to define said retaining space thereamong for retaining said mount portion.

4. The multi-stage trigger assembly as claimed in claim 3, further comprising a connecting rod that extends through said lateral walls of said trigger member and said mount portion of said driving member in a direction perpendicular to the direction of the axis (X) for pivotally interconnecting said trigger member and said mount portion.

5. The multi-stage trigger assembly as claimed in claim 4, the tool body being further formed with an elongate operation space that extends in the direction of the axis (X), wherein said trigger member further has an upper end portion that extends upwardly from said press portion and that is disposed above said lateral walls, said multi-stage trigger assembly further comprising a limiting member that is disposed fixedly in the operation space and that is located at one side of said upper end portion opposite to the valve unit, said mount portion of said driving member having upper and lower sections that are respectively located above and below said connecting rod, said upper end portion abutting against said limiting member and said press portion abutting against said upper section of said mount portion when said driving member is at the first position, so that said trigger member is pressable to pivot relative to said driving member until said press portion abuts against said lower section of said mount portion, thereby driving movement of said driving member from the first position to the intermediate position, after which said trigger member can be pressed again to move toward the valve unit for driving movement of said driving member from the intermediate position to the second position.

6. The multi-stage trigger assembly as claimed in claim 1, wherein said second positioning structure is configured as a recess, said first positioning structure including a ball body and a resilient member that resiliently biases said ball body into said second positioning structure only when said driving member is at the intermediate position.

7. The multi-stage trigger assembly as claimed in claim 1, further comprising a resilient member that has opposite ends adapted to be respectively connected to the tool body and said driving member for resiliently biasing said driving member and said trigger member away from the valve unit.

* * * * *